United States Patent [19]

Pinto et al.

[11] Patent Number: 4,771,513

[45] Date of Patent: Sep. 20, 1988

[54] APPARATUS FOR REDUCING THE MATERIAL OF ROWS OF BALES CONSISTING OF SPINNING MATERIAL

[75] Inventors: Akiva Pinto, Gastonia, N.C.; Gunter Lucasen, Haltern; Reinhard Schmidt, Gescher, both of Fed. Rep. of Germany

[73] Assignee: Hergeth Hollingsworth GmbH, Duelman, Fed. Rep. of Germany

[21] Appl. No.: 54,657

[22] Filed: May 27, 1987

[30] Foreign Application Priority Data

Jul. 1, 1986 [DE] Fed. Rep. of Germany ..... 3622014

[51] Int. Cl.[4] ..... D01G 7/00

[52] U.S. Cl. ..... 19/80 R; 19/81

[58] Field of Search ..... 19/80 R, 81

[56] References Cited

U.S. PATENT DOCUMENTS

| | | | |
|---|---|---|---|
| 4,477,944 | 10/1984 | Binder et al. | 19/80 R |
| 4,514,881 | 5/1985 | Hergeth et al. | 19/80 R |
| 4,544,106 | 10/1985 | Hackenbeck | 19/80 R |
| 4,595,149 | 6/1986 | Hergeth | 19/80 R |
| 4,660,257 | 4/1987 | Binder et al. | 19/81 X |
| 4,678,128 | 7/1987 | Hergeth | 19/80 R |

*Primary Examiner*—Louis K. Rimrodt

*Attorney, Agent, or Firm*—Cort Flint

[57] ABSTRACT

Apparatus is disclosed for reducing bales of fiber which includes a tower that reciprocates alongside a row of bales. The tower has a cantilevered portion which extends transversely over the row of the bales and supports two milling rollers for removing fiber from the upper surface of the bales. The cantilevered portion has a generally horizontal fiber collecting channel for receiving fiber removed from the bales, and includes a closed chamber in which is located a single drive for driving the two milling rollers in opposite directions. An adjustable vent permits passage of varying amounts of the atmosphere through the closed chamber. The closed chamber is connected to the horizontal channel so that air currents created by suction through the vent convey fibers removed from the bales by the milling rollers to a fiber collection point within the tower.

16 Claims, 4 Drawing Sheets

APPARATUS FOR REDUCING THE MATERIAL OF ROWS OF BALES CONSISTING OF SPINNING MATERIAL

BACKGROUND OF THE INVENTION

The invention relates to an apparatus for reducing the material of rows of bales of spinning material, e.g. of cotton, synthetic fibers, etc., comprising a tower displaceable along the row of bales and having a cantilevered portion extending transversely to the travel direction, the housing of the cantilevered portion containing an opening means formed by milling rollers and the removed flocks being carried away pneumatically by suction through the housing within the tower.

A reducing means of this kind has been known, for instance, from German published application No. OS 33 34 222 in which the suction capacity of the opening means is rendered independent from the accurate set-up of the row of fiber bales. To this end, there is provided at the air discharge side of the housing of the cantilevered portion, an air guiding surface extending into the housing above the milling means and below the suction piece at the end wall of the housing. As a result thereof, fibers or flocks removed from the fiber bales may be intensely sucked off also at the milling means ends confronted with the tower, even if the fiber bales are set up somewhat in disalignment.

Up to the present, in the cantilevered portion housing containing the milling means, the air circulation does not operate perfectly for the pneumatic absorption of removed fibers or flocks. This is not only true for the suction itself which conveys the fibers or flocks. In the cantilevered portion housing, there is also accommodated the driving means for the milling device which also calls for a special air circulation to obtain the maximum efficiency, the point of importance being to inhibit the formation of secondary air or to utilize it to some extent.

SUMMARY OF THE INVENTION

It is the object of the invention to provide a reducing means of the above mentioned type in which the suction operation in the cantilevered portion housing is effectively ensured and by which, at the same time, due to a ventilation system, the capacity of the driving means is improved.

The invention is characterized in that the cantilevered portion housing comprises, in the longitudinal center plane, a discharge channel covering the milling means upwardly and ascending towards the tower. At the side of the discharge channel, the driving means for the milling device is mounted in a downwardly closed chamber and an air supply is provided into the housing above the driving means, the air flow being further conveyed as far as to the discharge channel at the front housing end.

As a result of the design and the particular configuration of the cantilevered housing with regard to the suction air circulation for conveying removed fibers, etc. and for ventilating the chambers adjacent to the suction channel and used to accommodate the required driving means, the air conditions brought about by the reducing operation may be positively controlled to be utilized, at least partly, for ventilation and driving purposes. If secondary air cannot be excluded entirely, it is forcibly conducted for improving the suction. The secondary air is also used for cooling the housing and the circulating elements.

Due to the fact that the driving means is mounted in a closed, channel-type ventilated chamber, its environment may be kept relatively cool. Care is taken that air may not accumulate inside the housing. With the forced evacuation of heated air and by supply of fresh air the driving means is cooled and the efficiency is improved. Further, the inner spaces of the cantilevered housing may be kept free, to a great extent, from undesired fiber fly and resultant contaminations.

The upper wall of the housing is conveniently provided with air access openings near the side where the cantilevered housing is fixed to the tower. The air access may be controlled manually by an adjustable flap, or by a pressure control, thus ensuring an optimized air supply.

Further, the front side of the housing may include an air circulation channel for connecting the discharge channel side chambers with the discharge channel itself, it being possible for the free end of the housing to be fitted with an air guiding hood. By this means, air circulation along with cantilevered housing and outside the discharge channel for the removed fibers, etc. is automatically connected to the suction draft, said air necessarily complying with the duty of cooling the driving means.

According to another feature of the invention, the productivity of the driving means may not only be increased by cooling but also by its coupling to the driving device consisting of two driving rollers, in that the driving means is composed of a motor for the two milling rolls running in opposite directions to each other. The common motor may drive one milling roller, while the drive of the other milling roller may be derived from the first milling roller via suitable transmission members, e.g. a belt drive or the like. The common motor may also drive directly both milling rollers via one corresponding transmission member. It turned out, that, in case of different loading of the milling rollers, the motor efficiency is higher, subject to the operation direction, than in case of the provision of one respective independent motor for each milling roller.

BRIEF DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DETAILED DESCRIPTION OF THE DRAWINGS

Figure 1:
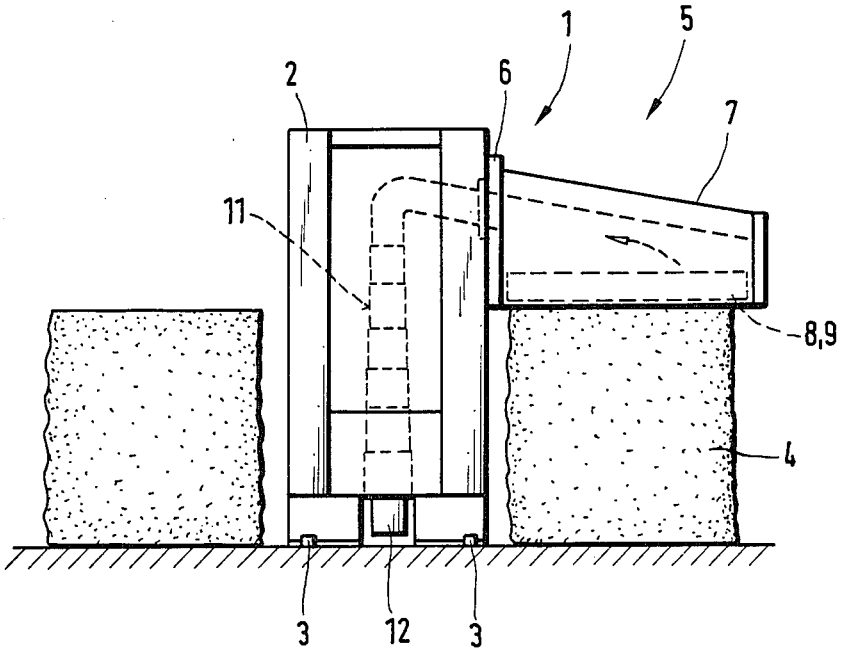
FIG. 1 shows an elevation and schematic view of a reducing means for fiber bales according to the invention.

The reducing means 1 for compressed fiber bales 4, set up in rows, comprises a tower 2 adapted to reciprocate on rails 3 alongside the row of bales 4. The tower is provided with a cantilevered housing 5 which is fixed to one side of the tower 2 by a flange 6. In housing 7 of the cantilevered housing, there is accommodated a milling means formed of two milling rollers 8, 9. These rollers, by rotating in opposite directions to the center of the roller pair, remove fibers or flocks from the top surface of the row of bales 4. These fibers are thrown upwardly intermediate them. By a pneumatic suction current, the removed fibers, etc., are drawn through a connecting tube 10 into the interior of tower 2, into a telescopic guide 11, which extends as far as lower suction channel 12. With the progressive decrease of height of the pressed bale, the cantilevered housing is lowered correspondingly.

The longitudinal center plane of housing 7 of the cantilevered housing comprises a channel 14 into which the fibers, flocks, etc., removed by the milling rollers 8, 9 are thrown to be conveyed by suction towards the tower. The two juxtaposed milling rollers 8 and 9 are partially covered by metal sheets or cowlings 15 and 16, which,from the cross sectional viewpoint, are shaped to conform to the milling rollers' contours and which extend as far as to shortly ahead of the lower peak of said milling rollers so as to prevent, as much as possible, the entrainment of secondary air. Due to the cover plates 15, 16, there is formed in the longitudinal center plane of the cantilevered housing 7, a suction channel 14 which is closed to the rear by the top partition 17. At the side of the vertically extending channel walls 15*a* and 16*a*, or of the discharge channel 14, the remaining space of the cantilevered housing 7 is adapted to accommodate a driving means for the two milling rollers 8, 9, which, advantageously, comprises a motor 19, mounted on one side of channel 14. The space 20, housing driving means 19, is closed by the bottom over the total length of the housing 7 by a wall 21. The motor shaft 19*a* projects through the end wall 22 to a driving pulley 23 from which the drive may be transmitted to the milling rollers outside the housing 7.

The closed space 20, having disposed therein motor 19, is provided with an air inlet 25 or an air intake by means of air entry openings or slots 26 provided in the upper wall of housing 7 and adjustable in width by slides, etc., not shown. The wall portion 27 with or without air entry openings 26 may be designed as a flap adapted to swing about hinges 28, and the degree of opening of said flap may be controlled at choice either manually or by means of a (nonillustrated) control device.

The end wall 30 at the free front end of the cantilevered housing 7 is fitted with passages 31 so that air may flow into the inner space 32 of an applied hood 33. Further, the front end wall 30 of housing 7 comprises a passage 34 from chamber 32 to the suction channel 14. the passage openings may be adjusted, for example, by a slide 34*a* or the like. For a control of the air supply by slides, etc., the central unit 34, 34*a* is generally sufficient. However, if necessary, air entry openings 35 or one or more controllable flaps may be provided in the upper housing wall at the front portion of housing 7, for example, for a motor, etc. installed at the front wall of housing 7, and adapted to drive, if necessary, other elements, e.g. a downholding means for the bales, etc.

Figure 2:
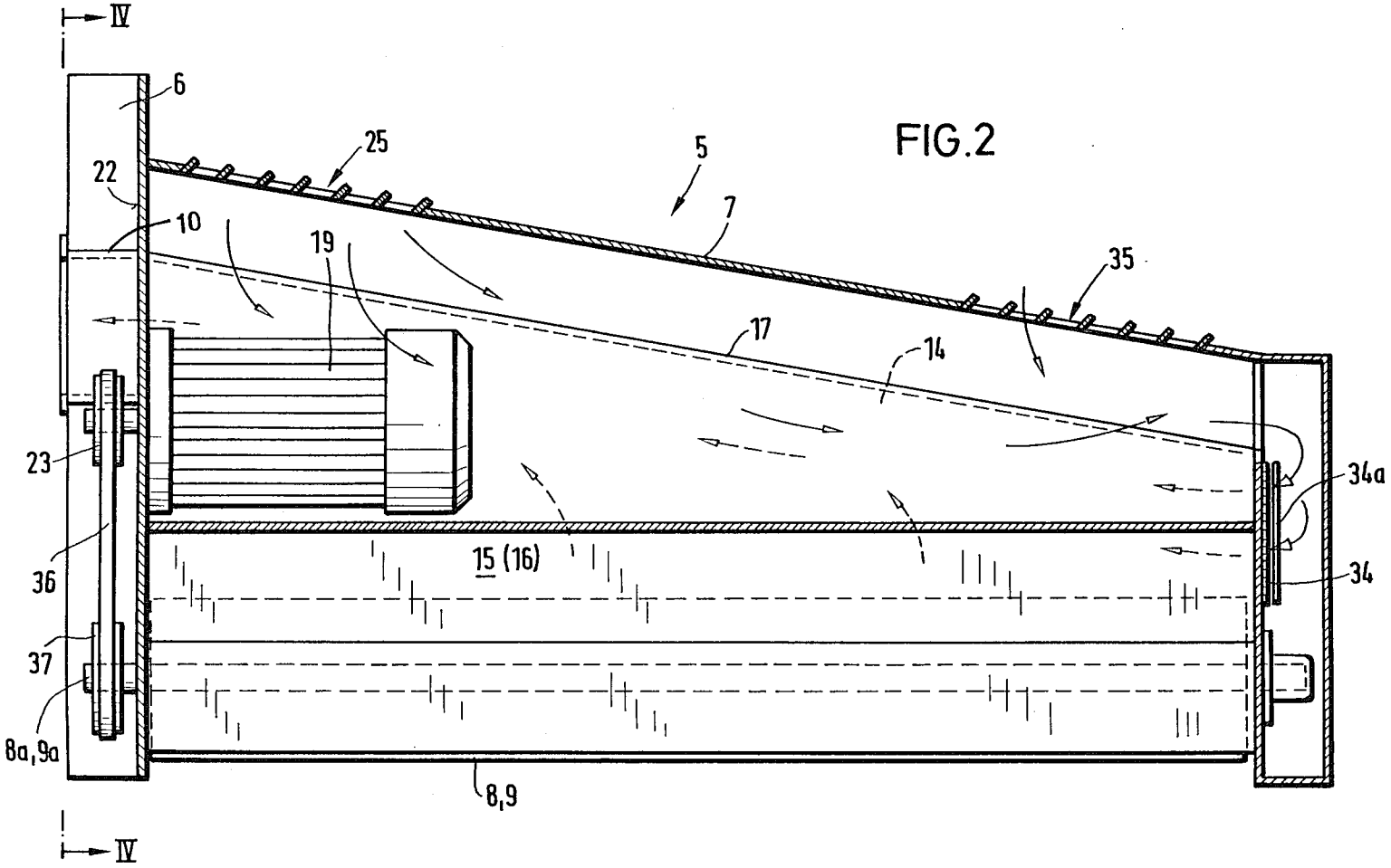
FIG. 2 is a scaled up and schematic view of the cantilever housing.
Figure 3:
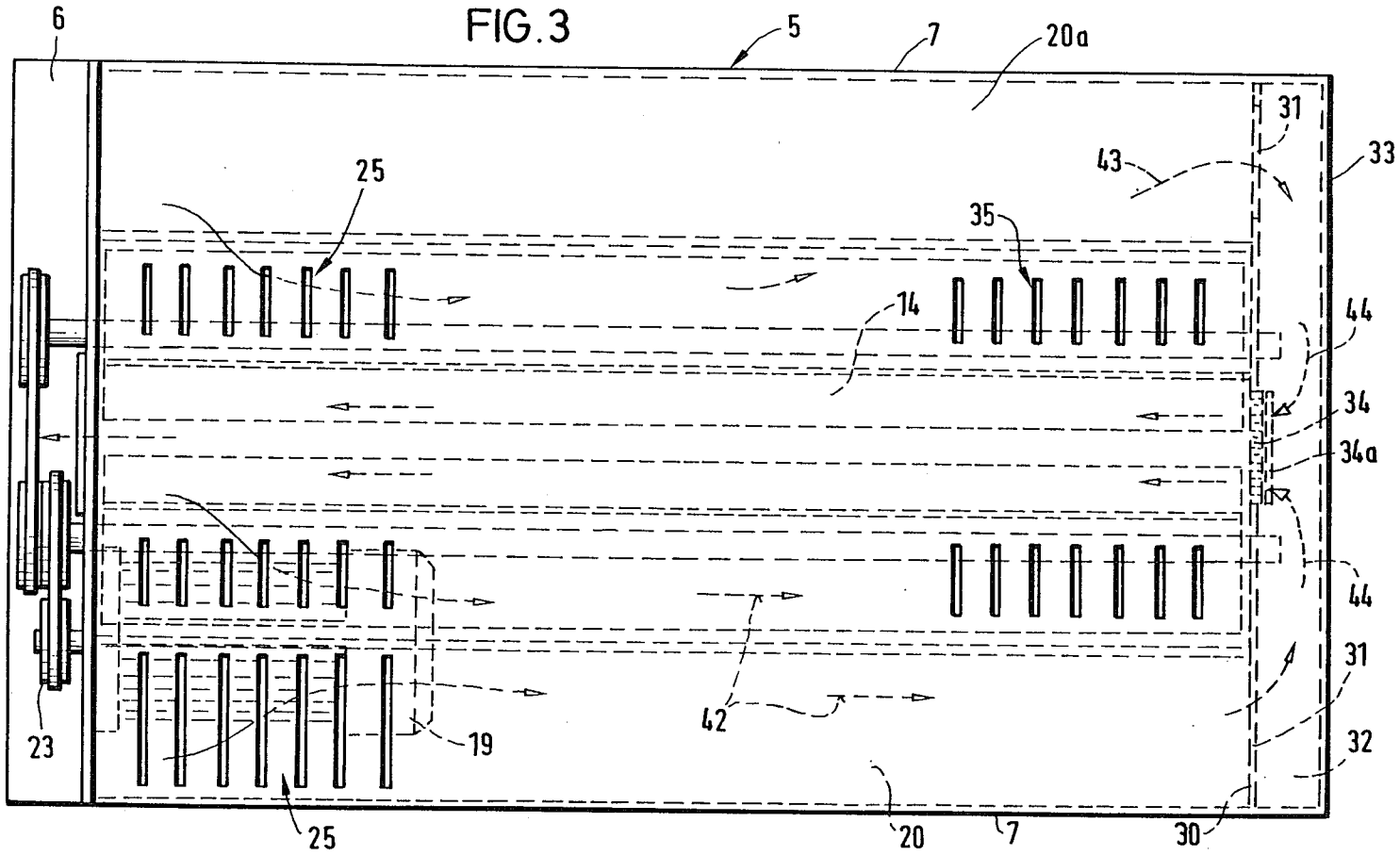
FIG. 3 is a schematic plan view of the cantilever housing of FIG. 2.
Figure 4:
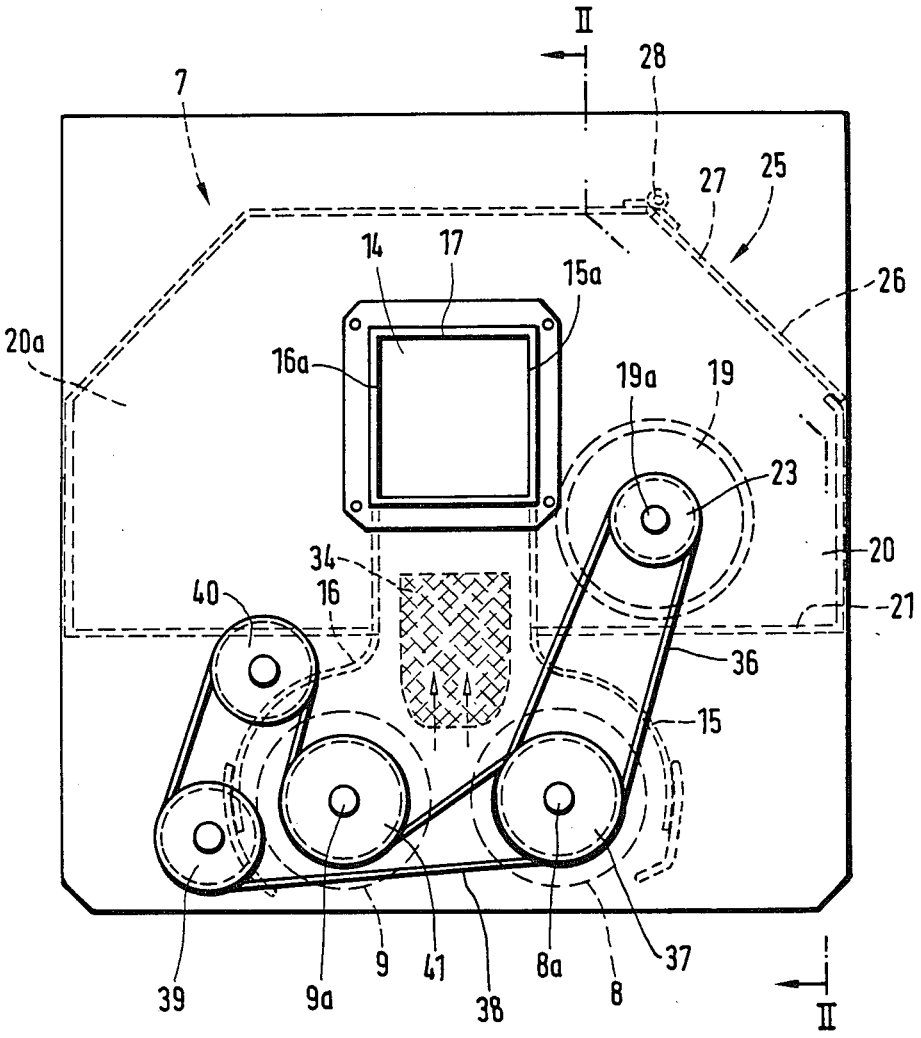
FIG. 4 is a schematic cross section along the line IV—IV of FIG. 2.

In FIGS. 2 and 4, the shaft 8*a* of the milling roller 8 is driven by motor 19 via a unit comprising a drive pulley 23 for a belt drive including, for example, a toothed or timing belt 36 and the belt pulley 37. On the other hand, shaft 9*a* of milling roller 9 is driven by a unit comprising belt drive 38 and guide pulleys 39 and 40 as well as the belt pulley 41. The elements of the transmission assembly 23 and 36 to 41 are outside the closed space on one side of channel 14 or of the closed space 20*a* on the other side of channel 14 so that the air circulation is not affected by the transmission elements.

Fresh air supplied through openings 25 and/or 36 will flow around the driving or motor means 19, should it be necessary to mount a motor in this space, and the suction draft acting in channel 14 towards the tower will be effective as far as to the openings 25 and 36. For example, fresh air flows along motor 19 in the direction of arrows 42 or 43 into space 32 of hood 33 and from there along arrows 44 through the opening 34, possibly including a grid or screen, into the suction channel 14. Thus, the driving means are cooled additionally. At the same time, care is taken that the formation of secondary air is reduced as much as possible. the circulation of secondary air which only can be insignificant in view of the design of housing 7 of cantilevered housing 5, is at least controlled and utilized effectively. What is essential is that the supply of fresh air is drawn through closed spaces of the cantilevered housing 7, along the driving means or elements, and through channel 14. due to this intentional positive ventilation, not only the motors, but also the housing may be cooled. Both effects contribute to an increase of capacity, in particular in the case where the milling rollers are driven by one motor only, which, of course, must be higher powered than where one for each milling roller. Such a common motor, of course, develops more heat which is to be discharged. The provided air circulation also serves for throttling secondary air to improve the efficiency of the reducing means, thus contributing to an increase in its production.

What is claimed is:

1. Apparatus for reducing bales of fiber arranged in a row, comprising:

(a) a tower disposed to reciprocate alongside said row of bales;

(b) a cantilevered portion of said tower having a housing which extends transversely over the upper surfaces of said bales;

(c) fiber opening means disposed within said housing, comprising milling rollers for removing fiber from the upper surfaces of said bales;

(d) a generally centrally located horizontal channel disposed in said housing above said milling rollers for receiving fibers removed from said bales by said milling rollers;

(e) driving means for driving said milling rollers in opposite directions, disposed within a closed chamber in said housing;

(f) vent means for admitting air to said closed chamber;

(g) a connecting channel for connecting said closed chamber to said horizontal channel;

(h) a discharge channel disposed within said tower and connected to said horizontal channel; and (i) suction means for drawing air through said vent, over said drive means for cooling it, through said connecting channel, said horizontal channel, and said discharge channel to draw fibers removed from said bales by said milling rollers, into and through, said horizontal and discharge channels to collect said reduced fiber and to cool said drive means.

2. Apparatus for reducing bales of fiber as set forth in claim 1, wherein said vent means is located in the top wall of said closed chamber adjacent to said tower.

3. Apparatus for reducing bales of fiber as set forth in claim 1, wherein means are provided for adjusting said vent means to adjust the amount of air admitted therethrough.

4. Apparatus for reducing bales of fiber as set forth in claim 3, wherein said vent means are provided with a slide for partially closing said vent.

5. Apparatus for reducing bales of fiber as set forth in claim 3, wherein said vent means is provided with an adjustable flap for controlling the amount of air admitted therethrough.

6. Apparatus for reducing bales of fiber as set forth in claim 3, wherein said vent means are adjustable by a pressure sensing control means.

7. Apparatus for reducing bales of fiber as set forth in claim 1, wherein said milling rollers are driven in the opposite direction by means of a common motor.

8. Apparatus for reducing bales of fiber as set forth in claim 7, wherein said common motor directly drives each of said milling rollers through transmission means.

9. In an apparatus for reducing bales of fiber, arranged in a row, comprising a tower displaceable alongside said row of bales and having a cantilevered portion extending from said tower, transversely over said row of bales, said cantilevered portion having an opening means which includes milling rollers for removing fiber from the upper surfaces of said bales and pneumatic means for conveying said fiber through said cantilevered portion, wherein said cantilevered portion comprises:

(a) a centrally disposed horizontal channel extending above and along said milling rollers for receiving fiber removed from the upper surfaces of said bales by said milling rollers;

(b) drive means for driving said milling rollers in opposite directions, disposed within a closed chamber in said cantilevered portion;

(c) vent means for admitting air to said closed chamber;

(d) a discharge channel disposed within said tower and connected to said horizontal channel;

(e) a connecting channel for connecting said closed chamber to said horizontal channel; and (f) suction means for drawing air through said vent, over said drive means, through said connecting channel, through said horizontal channel, and through said discharge channel, to draw air currents over said driving means for cooling it and to draw fibers from said milling rollers into and through said horizontal and discharge channels.

10. Apparatus for reducing bales of fibers as set forth in claim 9, wherein said vent means is located in the top wall of said closed chamber adjacent to said tower.

11. Apparatus for reducing bales of fiber as set forth in claim 9, wherein means are provided for adjusting said vent means to adjust the amount of air admitted therethrough.

12. Apparatus for reducing bales of fiber as set forth in claim 11, wherein said vent means are provided with a slide for partially closing said vent.

13. Apparatus for reducing bales of fiber as set forth in claim 11, wherein said vent means is provided with an adjustable flap for controlling the amount of air admitted therethrough.

14. Apparatus for reducing bales of fiber as set forth in claim 11, wherein said vent means are adjustable by a pressure sensing control means.

15. Apparatus for reducing bales of fiber as set forth in claim 9, wherein said milling rollers are driven in the opposite direction by means of a common motor.

16. Apparatus for reducing bales of fiber as set forth in claim 15, wherein said common motor directly drives each of said milling rollers through transmission means.

* * * * *